US007896257B2

(12) United States Patent
Yan

(10) Patent No.: US 7,896,257 B2
(45) Date of Patent: Mar. 1, 2011

(54) FUEL INJECTOR WITH REAL-TIME FEEDBACK CONTROL

(76) Inventor: Mi Yan, Columbus, IN (US)

( * ) Notice: Subject to any disclaimer, the term of this patent is extended or adjusted under 35 U.S.C. 154(b) by 63 days.

(21) Appl. No.: 12/378,415

(22) Filed: Feb. 14, 2009

(65) Prior Publication Data

US 2009/0206184 A1 Aug. 20, 2009

Related U.S. Application Data

(60) Provisional application No. 61/065,840, filed on Feb. 16, 2008.

(51) Int. Cl.
*F02M 47/02* (2006.01)

(52) U.S. Cl. ..... 239/92; 239/88; 239/102.2; 239/533.9; 239/585.1; 239/71; 123/446

(58) Field of Classification Search ..... 239/88, 239/92, 96, 102.2, 533.4, 533.8, 533.9, 584, 239/71, 585.1; 123/446, 472, 506
See application file for complete search history.

(56) References Cited

U.S. PATENT DOCUMENTS 4,129,255 A * 12/1978 Bader et al. ..... 239/96
5,335,852 A * 8/1994 Muntean et al. ..... 123/446
6,003,497 A * 12/1999 Rodier et al. ..... 239/88

* cited by examiner

*Primary Examiner* — Steven J Ganey

(57) ABSTRACT

A fuel injection apparatus with a piston device that includes a channel and a piston in the channel. A position sensor is used to detect the piston movement inside the channel when the fuel injection apparatus is energized and de-energized, and the sensing value is used for controlling fuel injection rate in real-time and diagnosing failures in the apparatus. With an actuator installed, the piston can also be used for independently modulating fuel pressure during fuel injection. Thereby the shape of fuel injection pulses is controlled. The fuel injection apparatus has three injection states, and flexible fuel injection timing and multi-pulse injection are allowed. Furthermore, in all injection states, fuel supply has no direct contact to combustion chamber. As a result, when a malfunction sticks the apparatus open, no fuel is supplied. This feature provides a safety nature to the fuel injection apparatus.

19 Claims, 13 Drawing Sheets

FUEL INJECTOR WITH REAL-TIME FEEDBACK CONTROL

This present application claims priority from U.S. provisional application No. 61/065,840 having the same title as the present invention and filed on Feb. 16, 2008.

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

FIELD OF THE INVENTION

The present invention relates to a fuel injection apparatus that provides and controls fuel flow.

BACKGROUND OF THE INVENTION

Fuel injectors are used to direct fuel into a combustion chamber. Normally inside a fuel injector, fuel is pressurized, and a nozzle assembly including a nozzle valve (nozzle needle valve) is used to control fuel flow through nozzle orifices. At "off" position, the nozzle valve blocks fuel flow. When the nozzle valve moves to "on" position, fuel is injected through the orifices. The overall fueling rate is controlled either by pre-metering fuel (e.g. unit injectors) or controlling the injector "on" time (e.g. common rail systems).

Due to the high pressure high temperature working environment in fuel injectors, it is hard to measure the fueling flow rate directly. As a result, fueling rate control for most injectors is open-loop feed-forward control. Control error and injector deterioration may cause poor combustion and emission issues.

Air-fuel ratio (lambda) control can be used for adjusting fueling rate indirectly. However, in air-fuel ratio control, the goal is to control air-fuel ratio rather than fuel injection rate. In the control system, therefore, the whole fuel system including fueling rate control modules is part of control plant to the air-fuel ratio controller. Performance change in fueling rate control, especially that caused by fuel system deterioration is a perturbation to the control system rather than a disturbance, causing deterioration in air-fuel ratio control.

Additionally, lambda sensors normally are positioned at the downstream of exhaust manifold. Therefore, the adjustment of fueling rate actually is for all cylinders rather than individual ones. Fuel injector deterioration in some cylinders may cause over or under fueling in other cylinders, resulting in fuel economy, torque balance, and emission issues.

The shape of fueling pulses is important to combustion. Normally, fueling pulse shape can be controlled either by modulating fuel pressure or changing injector geometry during fuel injection. In common-rail systems, fuel pressure is kept constant, resulting in that fuel pulse shape can only be controlled by adjusting injector geometry. However, injector geometry change could deteriorate fuel atomization and penetration, causing combustion and emission issues. In pre-metered systems, fuel pressure is applied with the movement of engine camshaft. On one hand, it is relatively easier to modulate the pressure for controlling injection pulse shape. On the other hand, however, the injection pulse shape is strongly affected by engine camshaft speed.

Fuel systems, especially systems in Cl (Combustion Injection) engines, must be highly reliable. In common-rail systems, a high constant fuel pressure is maintained. If a malfunction causes an injector valve being stuck open, fuel could be injected into combustion chamber continuously, causing catastrophic results. In pre-metered systems, though a stuck open injector won't lead to continuous fuel injection, losing pre-metering control could still cause ill combustion, emission, and safety issues.

To solve the drawbacks of common-rail systems and pre-metered systems, a fuel system needs to have real-time feedback control and flexible fueling shape control with fuel pressure modulated independently. The fuel system should also be highly reliable. Malfunctions such as valve being stuck open should not cause emission and safety issues.

BRIEF SUMMARY OF THE INVENTION

It is an objective of the present invention to provide a fuel-injection device with an apparatus that can be used for measuring fuel injection rate.

Another objective of the present invention is to provide a real-time feedback control system directly correcting fuel injection according to fueling rate commands.

Yet another objective of the present invention is to provide a fuel-injection device that allows fueling pulse shape be controlled by modulating fuel pressure independent to engine camshaft speed.

Yet another objective of the present invention is to provide a fuel-injection device having flexible fuel injection timing control.

Yet another objective of the present invention is to provide a safe fuel-injection device that won't cause safety issues and emission when the device is falsely stuck open.

Yet another objective of the present invention is to provide a fuel-injection device that allows diagnosis for device malfunctions including device stuck closed, device stuck open, and device deterioration.

In one embodiment of the present invention, fuel injection rate is measured using a piston device inside a fuel injector. The piston device includes a channel communicating to the nozzle pressure cavity of the fuel injector and a sliding piston inside the channel. On one end (upper head) of the sliding piston, high pressure is applied by fuel supply, while on the other end (lower head), which connects to the pressure cavity, fuel pressure is determined by injector status. When the injector is in "off" state, i.e., the injector needle valve is in seat, the lower head connects to fuel supply though a conduit in the needle valve and a conduit in the injector body, and fuel supply pressure is applied. After the needle valve leaves its seat, fuel supply is cut off. When the needle valve moves further connecting the nozzle pressure cavity to combustion chamber (the injector is in an "on" state), a fuel pressure drop is generated. Under the pressure difference, the piston moves downward, pressing a return spring positioned in between the upper head and a restraint inside the channel. The piston displacement, which is proportional to fuel injection amount and fueling rate, is measured by a position sensor installed in the piston device, and fueling rate is calculated therewith. When the needle valve returns to its seat, fuel pressure is applied to the piston lower head balancing that on the upper head. Under the stress provided by the return spring, the piston returns to its original position.

Using the piston displacement measurement, fueling rate can be monitored in real time, and thereby real time feedback control is enabled. Two examples are used to demonstrate the feedback control. In one example, piston displacement calculated using piston position sensing value is compared with a target piston position calculated based on fueling rate command. The difference (error) is then fed into a feedback controller, where a correction control value is generated and the output of the feedback controller is added to a feed-forward value calculated according to the fueling rate command. The result signal is used for controlling the injector open time upon a fuel injection trigger signal.

In another example, two control loops are employed. An inner loop is used for controlling fuel injection amount in an injection pulse, while fueling rate is corrected in an outer loop. In the inner loop, piston position information together with a fuel injection amount command, a fuel injection trigger signal, and fuel pressure are used for generating injector control signals. The piston position value is also used for calculating fueling rate in the outer loop. The result fueling rate value is compared with the fueling rate command and a feedback controller uses the error for calculating a correction signal, which adds to a feed-forward signal calculated according to the fueling rate command in generating the fuel injection amount command for the inner control loop.

In addition to real-time feedback control for fueling rate, the piston device also facilitates controlling the shape of fuel injection pulses. In another embodiment of the present invention, an actuator module which includes an actuator and a position sensor is positioned in between the spring constraint and the lower head of the piston. Controlled by an ECM (Engine Control Module), the actuator applies a stress that modulates fuel pressure during injection, resulting in fueling pulse shape change. With fuel supply pressure being controlled constant, the fuel pressure modulation is independent to engine camshaft speed.

In the present invention, fuel injection is controlled by injector open time. Flexible injection timing and multi-pulse injection are allowed. Furthermore, in all fuel injection states, fuel supply has no direct contact to combustion chamber. This feature results in that when a malfunction causes the injector being stuck open, the only fuel that can enter combustion chamber is that enclosed in the pressure cavity and in the channel. With this safety nature, a stuck open injector can only cause a dead cylinder, deteriorating engine performance without causing other issues.

The piston device also provides means for diagnosing fuel injection problems. When an injector is energized, a measurable piston displacement should be detected within a period of time, otherwise, the injector is stuck closed. Similarly, leaking injector or stuck open injector can be detected by measuring the time for the piston to return to its original position or measuring the piston displacement at a set moment after the injector is de-energized.

Using the difference between fuel pressure and combustion chamber pressure, expected piston position can be calculated with given fuel properties, cross section area of the piston channel, and the overall cross section area of nozzle orifices. Accordingly, when injector deterioration causes change in the nozzle orifice area (e.g. injector tip is worn or damaged), the measured piston displacement disagrees with the predicted values. The difference value can then be used for diagnostics and adaptive compensation in fueling control.

DETAILED DESCRIPTION OF THE INVENTION

Figure 1A:
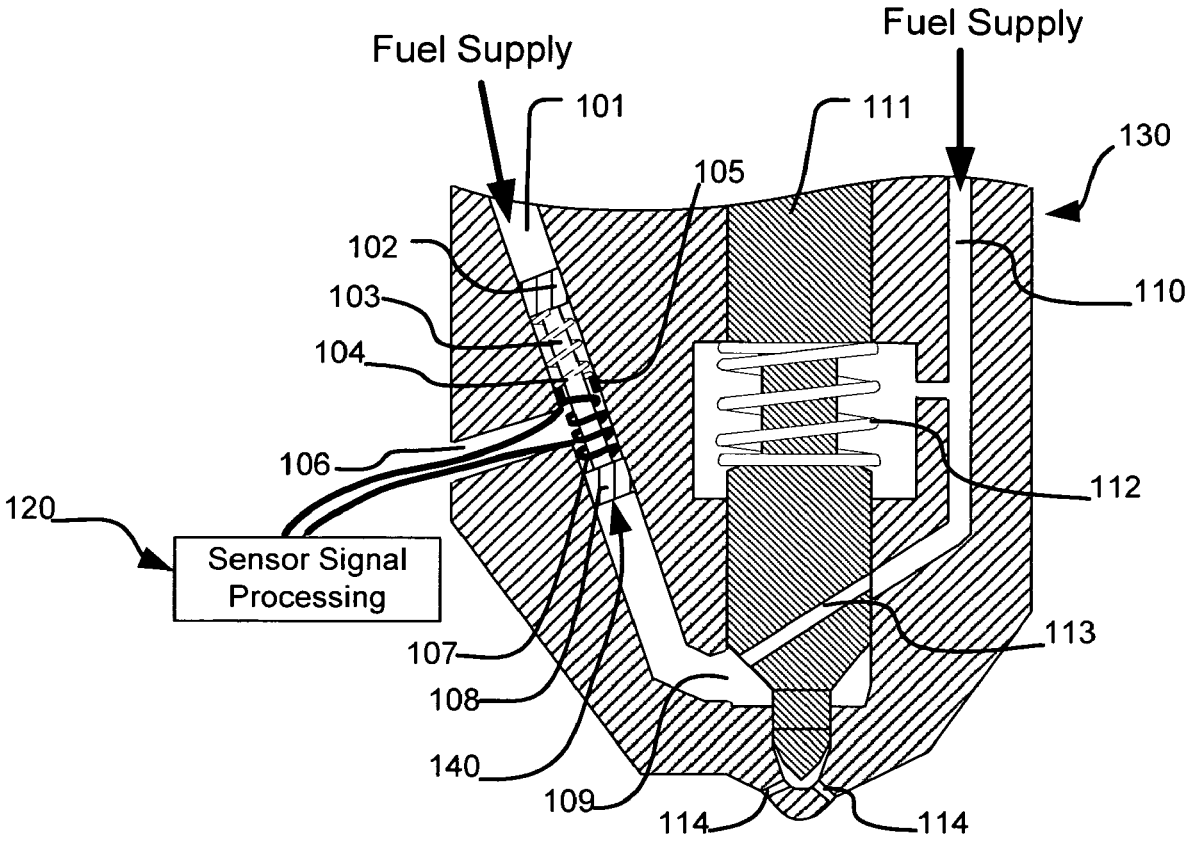
FIG. 1*a*, FIG. 1*b*, and FIG. 1*c* are cross-sectional schematic views illustrating the bottom part of an injector with a piston device according to a first embodiment of the present invention.

Referring to FIG. 1*a*, an injector 130 includes a needle valve 111, which controls fuel flow. When the needle valve leaves its seat, a spring 112 is pressed and a cavity 109 inside the injector 130 connects to combustion chamber (not shown) through injector orifices 114 allowing high pressure fuel in the cavity being spayed out. After an injection completes, the valve needle returns to its seats under the stress provided by the spring 112, blocking fuel from entering combustion chamber. Inside the needle valve 111, a conduit 113 connects a conduit 110 in the injector body to the cavity 109 when the needle valve is in its seat. The cavity 109 also connects to a channel 101, in which a piston 140 separates the fuel inside the cavity 109 from a high pressure fuel supply. The piston 140 includes a return spring 104, an upper head 102, a lower head 108, and a connecting rod 103 between the upper and lower heads. The spring 104 is positioned between the upper head 102 and a spring restraint 105 disposed inside the channel 101. On the connecting rod 103, a position sensor 107, which connects to a sensor signal processing unit 120 through a conduit 106, is used for detecting the movement of the piston.

Figure 1B:
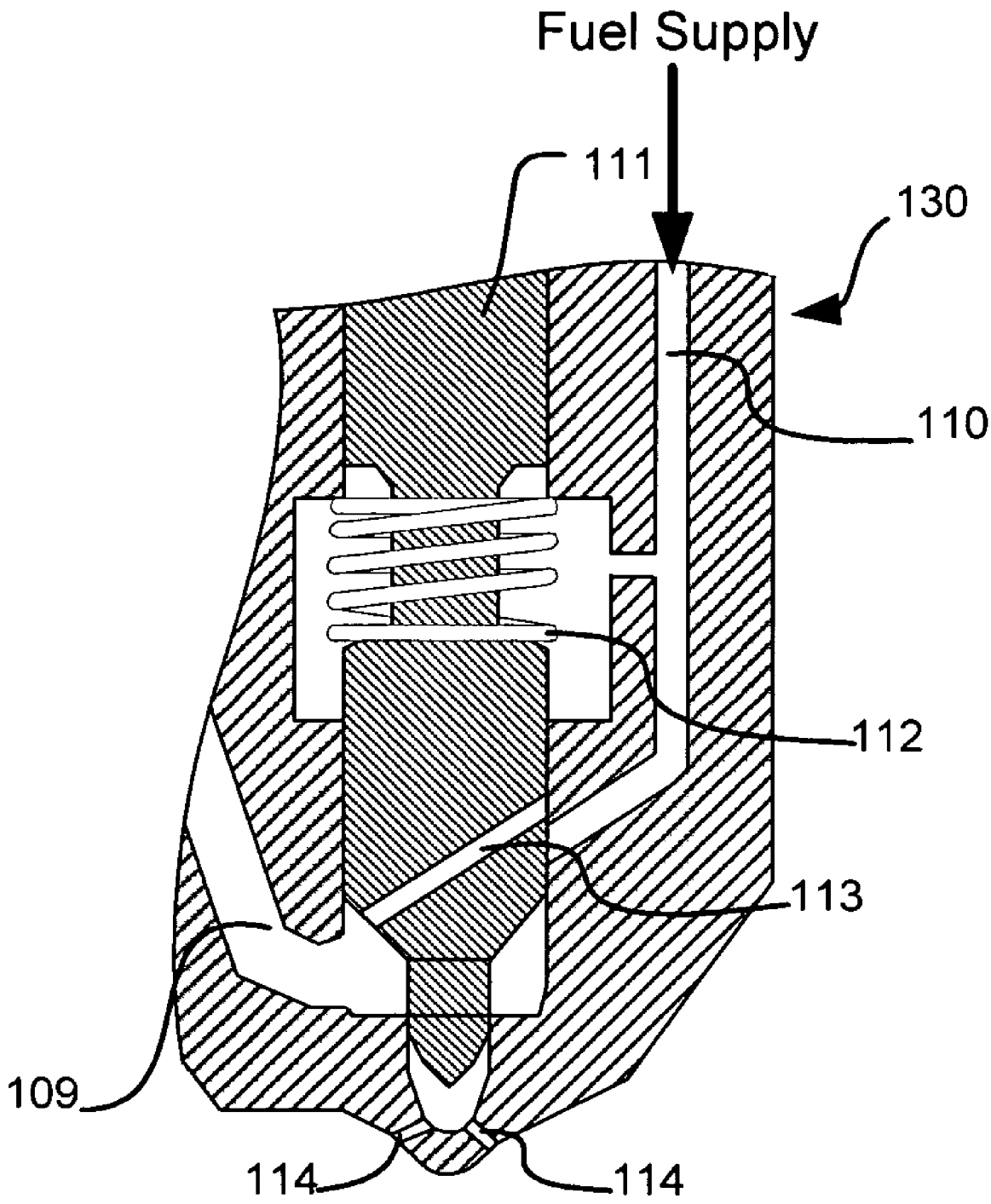

The injector 130 has three states during operation. The first one is the "off" state. As shown in FIG. 1*a*, in this state, the needle value 111 is in its seat, having the cavity 109 connect to the conduit 110 through the conduit 113, thereby higher pressure fuel goes into the cavity, applying fuel supply pressure on the piston lower head 108. On the other side of the piston, the same fuel supply pressure applies on upper head 102, balancing the piston at equilibrium status. When the needle valve leaves its seat, with the conduit 113 disconnected from the conduit 110 while still blocking the fuel in the cavity 109 from entering combustion chamber, as depicted in FIG. 1*b*, the injector goes into the second state, "blocking" state. In this state, the cavity 109, in which the pressure still equals to fuel supply pressure, is separated from fuel supply. After the needle valve 112 completely leaves its seat, referring to FIG. 1*c*, the cavity 109 connects to combustion chamber through orifices 114. The high pressure fuel then is squeezed out from the cavity, causing the pressure on the piston lower head 108 lower than fuel supply pressure. Under the pressure difference between fuel supply pressure on the piston upper head 102 and the pressure on the lower head 108, the piston moves downward and the return spring 104 is pressed. This injector state is called "on" state. In this state, if the piston displacement is l, then the volume of injected fuel (fuel injection amount) is v:

$$v=lA \tag{1}$$

where A is the cross section area of the channel 101.

According to equation (1), the fuel injection amount can be calculated from the piston displacement measured using the position sensor 107. After an injection is completed, the needle valve 111 returns to its seat. The injector then goes back to the "off" state with the cavity 109 connected to fuel supply. And high pressure fuel thus goes into the cavity, increasing the pressure on the lower piston head 108 to fuel supply pressure. Under the stress provided by the pressed return spring 104, the piston 140 move upward until it goes back to the equilibrium position.

Figure 2:
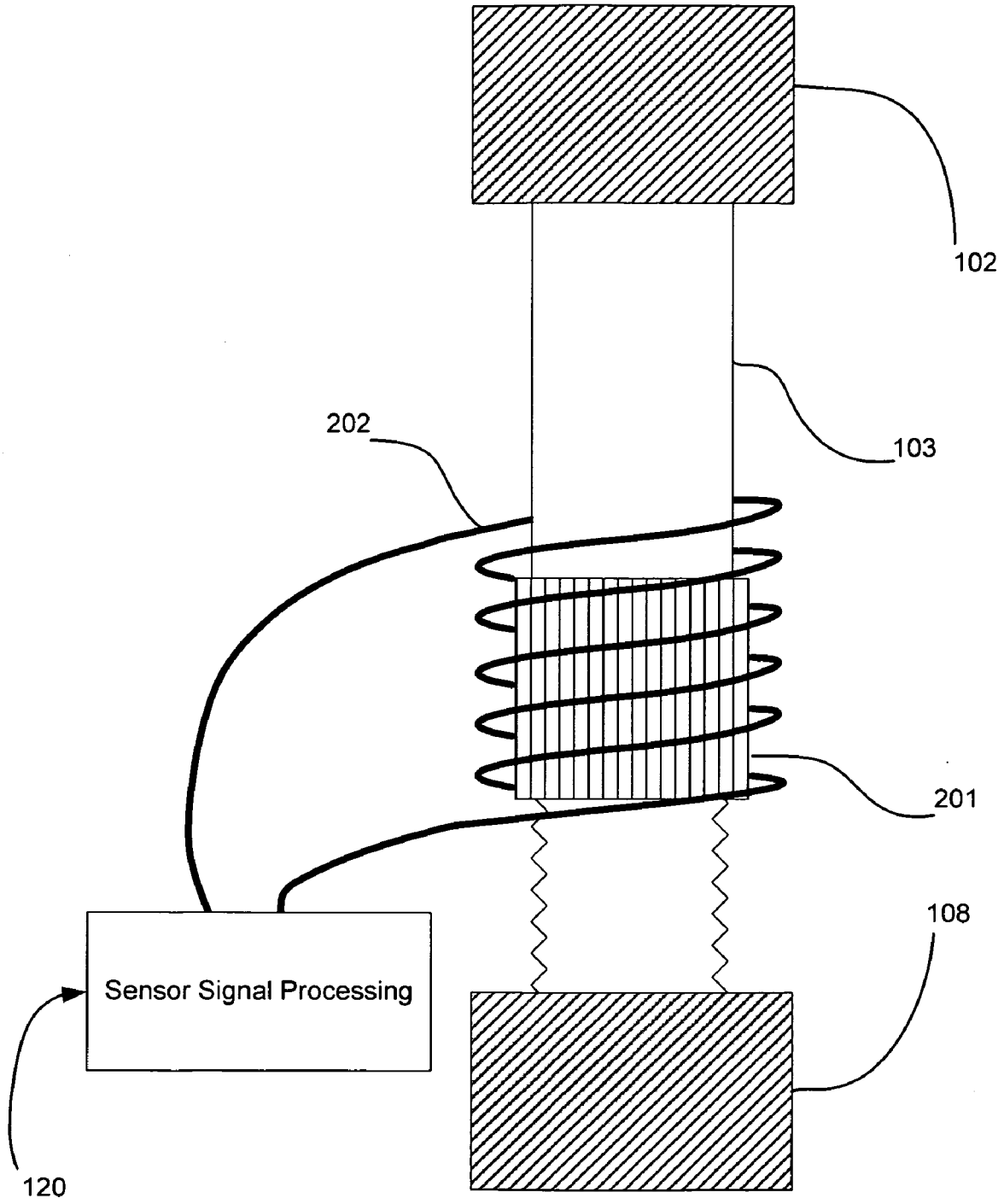
FIG. 2 shows an example of the piston position sensor.

In the injector 130, the piston position sensor 107 can be any type of sensor including but not limit to resistive sensors, capacitive sensors, inductive/LVDT sensors, Hall Effect sensors, magnetoresistive sensors, magnetostrictive sensors, and optical sensors/encoders. An example of inductive piston position sensor is shown in FIG. 2. The piston position sensor includes a magnetically permeable core 201, which is screwed on the connecting rod 103 and a sensing coil 202 mounted inside the channel 101 (not shown in FIG. 2). When the piston 140 moves, the core 201 moves with it. The relative position change between the coil 202 and the core 201 is then detected by measuring variation in coil inductance, which is monitored in the sensor signal processing unit 120.

Figure 3:
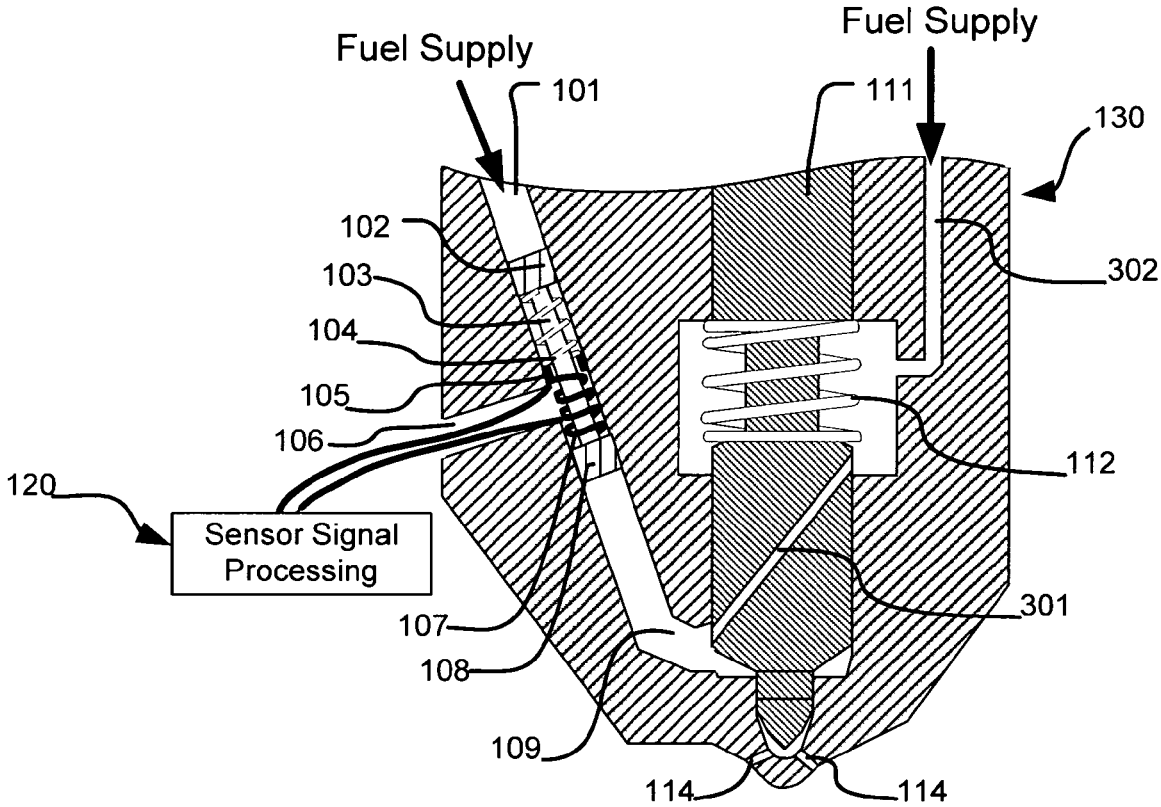
FIG. 3 is a cross-sectional schematic view illustrating the bottom part of an injector with a different injector needle valve design according to the first embodiment of the present invention.

A variety of designs are available for the conduit 113 in the needle valve 111. As an example illustrated in FIG. 3, a conduit 301 is used for connecting the cavity 109 to fuel supply through a conduit 302 in the injector body. Compared to the conduit 113 in FIG. 1, in all the three injector states, one end of the conduit 301 always connects to fuel supply rather than the cavity 109. The other end of the conduit 301 connects to the cavity 109 in the "off" state and is blocked in the "blocking" and "on" states.

With the fuel injection amount measured using the piston device, real-time feedback control for fueling rate is enabled. Normally, due to the high pressure high temperature working environment in fuel injectors, it is hard to measure the fueling flow rate directly. As a result, fueling rate control for almost all types of injectors is open-loop feed-forward control, in which fueling rate is controlled using either pre-metered method or by controlling injection time (injector open time) at constant pressure without correction for injection error.

Pre-metered fueling control is used in unit injector systems, in which the fuel is metered according to fuel injection amount and loaded before an injection starts. Then a high pressure is applied to the fuel injector opening injector nozzle and spraying fuel into combustion chamber. Injection time control normally is used in common-rail fuel systems, in which a constant high pressure is maintained in fuel rail. Fuel injection amount is controlled by controlling injector nozzle open time. Theoretically, at quasi-steady state, the fueling mass flow rate is determined by the following equation:

$$\dot{m}_f=C_D A_n\sqrt{2\rho_f \Delta p} \tag{2}$$

where $\dot{m}_f$ is the fuel mass flow rate, $C_D$ the discharge coefficient, $A_n$ the overall cross section area of orifices (orifice area), $\rho_f$ the fuel density, and $\Delta p$ the difference between fuel pressure and combustion chamber pressure. And the overall fuel injection amount $v_p$ in an injection pulse can be estimated using equation:

$$v_p=\int_0^{t_p}\dot{m}_f\rho_f dt \tag{3}$$

where $t_p$ is the fuel injection time (injection pulse width). According to equations (2) and (3), the fuel injection time is determined by applied fuel pressure for a given fuel system. When fuel pressure is controlled constant, equation (3) can be further simplified as:

$$v_p=\dot{m}_f\rho_f t_p \tag{4}.$$

Fueling rate can be indirectly corrected in air-fuel ratio (lambda) control, in which the air-fuel ratio in exhaust air is measured and compared to a set value. Fueling rate is then adjusted according the difference between measured air-fuel ratio value and the set value to correct the air-fuel ratio in exhaust air. However, in air-fuel ratio control, the goal is to control air-fuel ratio rather than fuel injection rate. In the control system, therefore, the whole fuel system including fueling rate control modules is part of control plant to the air-fuel ratio controller. Accordingly performance change in fueling rate control, especially that caused by fuel system deterioration is a perturbation to the control system rather than a disturbance, causing the air-fuel ratio control being deteriorated. Additionally, air-fuel ratio (lambda) sensor normally measures lambda value in exhaust flow at the downstream of the exhaust manifold. Therefore, the adjustment for fueling rate actually is for the average or overall fueling rate of all cylinders rather than individual cylinders. Fuel injector deterioration in some cylinders may cause over or under fueling in other cylinders, resulting in fuel economy, torque balance, and emission issues.

Figure 4A:
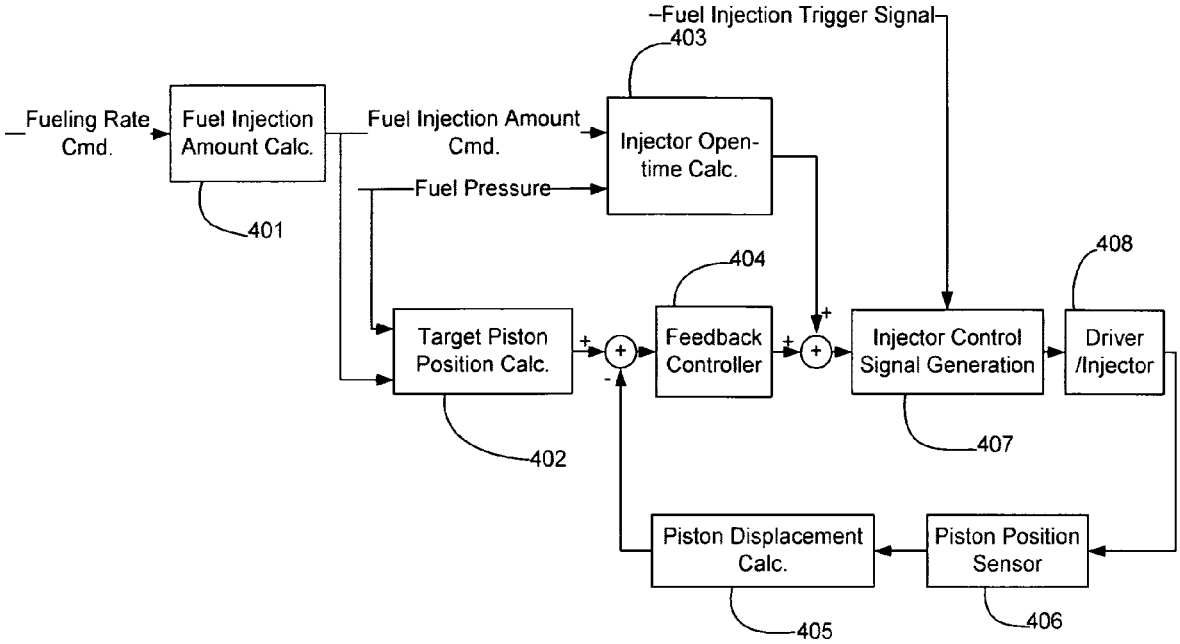
FIG. 4*a* and FIG. 4*b* are block diagrams of fueling rate control systems.

In the present invention, with the sensing value obtained with the piston position sensor, a real-time feedback control can be used controlling fueling rate. The block diagram of an exemplary fueling control system is depicted in FIG. 4*a*. In this control system, a fuel injection amount command (Fuel Injection Amount Cmd., could be in units of ml) is calculated from a fueling rate command (Fueling Rate Cmd., could be in units of ml/stroke or ml/injection pulse) through a block 401 (Fuel Injection Amount Calc.). In a feed-forward control block 403 (Injector Open-time Calc.), an injector open-time baseline is calculated based on the fuel injection amount command and fuel pressure. The sum of the injector open-time baseline value with a correction value generated by a feedback controller in a block 404 (Feedback Controller) is fed into a block 407 (Injector Control Signal Generation) as an injector open-time control signal. Upon a fuel injection trigger signal, an "on" signal is generated in the block 407 for energizing an injector through a driver (block 408), and a timer is started. When the timer value equals to the injector open-time (the sum of the values generated in the feed-forward control block 403 and the feedback control block 404), an "off" signal is triggered and the injector is then de-energized. The movement of the piston 140 during fuel injection is measured through the position sensor 107 in a block 406 (Piston Position Sensor) and the maximum displacement value is obtained in a block 405 (Piston Displacement Calc.). The measured displacement value is then compared with a target value calculated based on the fuel injection amount command in a block 402 (Target Piston Position Calc.). The result error value is used by the feedback controller in the block 404 for calculating the injection open-time correction values.

Both of the maximum piston displacement values and the piston position sensing value can be used in feedback control.

Figure 4B:
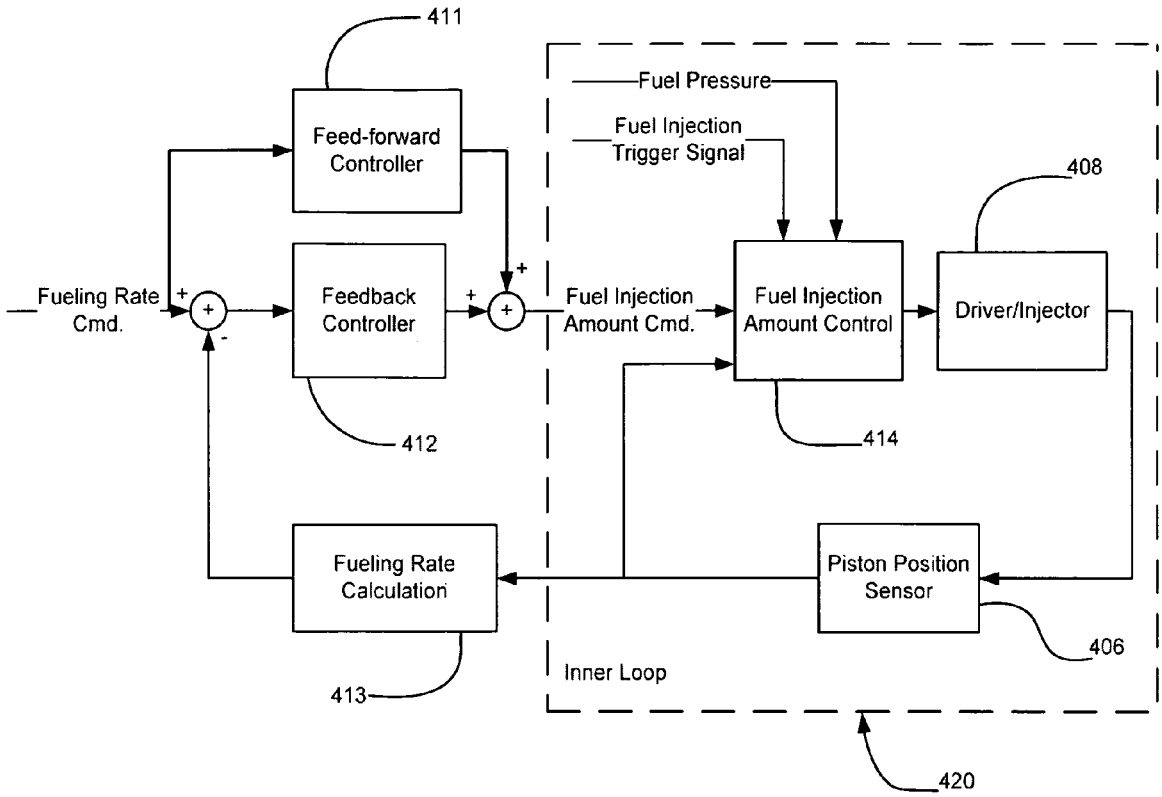

Referring to FIG. 4*b*, in another example, a controller includes an inner loop 420, which controls fuel injection amount, and an outer loop that provides fuel injection amount command for the inner loop. In the inner loop 420, a block 414 (Fuel Injection Amount Control) generates control signals for the driver (block 408), which energizes and de-energizes the injector. The piston position sensor (block 406) inside the injector reports the piston movement to the block 414. The piston position value is also used in a block 413 (Fueling Rate Calculation) for calculating fueling rate according to equation (1). The result value is compared with a fueling rate command, generating an error used by a feedback controller block 412 (Feedback Controller) in calculating corrections for the fuel injection amount command. A feed-forward controller block 411 (Feed-forward Controller) is used in calculating a baseline for the fuel injection command based on the fueling rate command. And the sum of the calculation results from the blocks 411 and 412 is fed into the block 414 as the fuel injection amount command.

Figure 5:
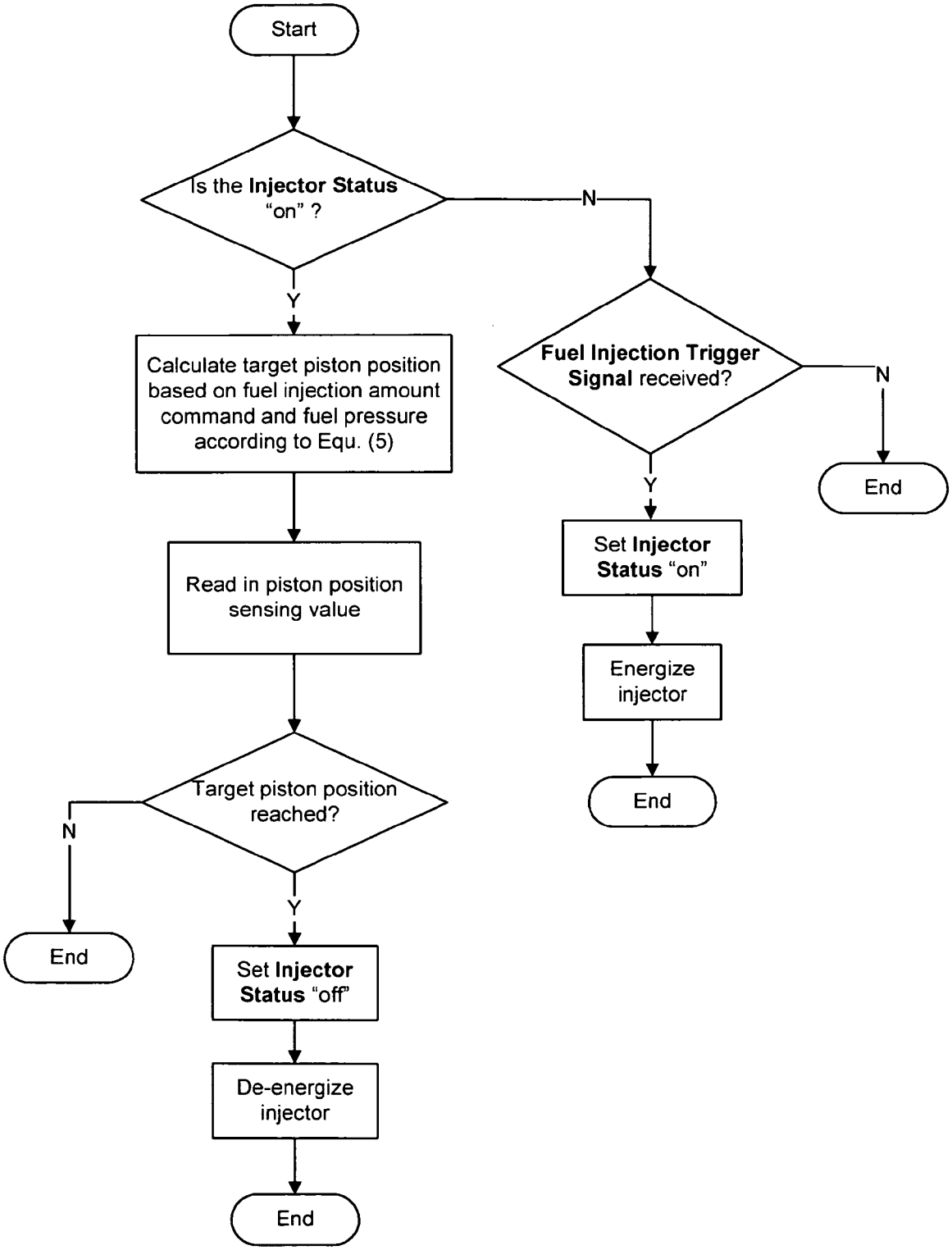
FIG. 5 is a flowchart for an exemplary realization of the Fuel Injection Amount Control block in the fueling rate control system shown in FIG. 4*b;*

In the inner loop 420, the fuel injection amount control (block 414) calculates control signals based on the fuel injection amount command, a fuel injection trigger signal and fuel pressure. This control block can be realized using a routine run with a TPU (Timer Processing Unit) in an ECM (Engine Control Module). The flowchart of an exemplary routine is shown in FIG. 5. When the routine starts, firstly an injector status flag is examined. If it is not "on", then the routine ends when no fuel injection trigger signal is received. Upon the fuel injection trigger signal, the injector status is set to "on" and the injector is energized before the routine ends. When the injector status is "on", the routine calculates a target piston position value based on the fuel injection amount command and fuel pressure. Normally the relation between the fuel injection amount and the piston displacement follows equation (1). However, due to inertia (FIG. 6), after the injector is shut off, the piston will keep moving a distance Δl, the value of which is a function of fuel pressure, before it starts moving back. To better estimate the target piston position, a correction can be added to the value calculated using equation (1):

$$\text{Target piston position}=\text{Original piston position}+v_c/A+f(\Delta p) \tag{5}$$

where Original piston position is the piston position before the injector is energized, $v_c$ the fuel injection amount command, and the compensation function is $f(\Delta p)$. After the target piston position is calculated, it is compared with the current piston position sensing value. The routine ends when target piston position is not reached, otherwise, the injector status is set to "off" and the injector is de-energized before the routine ends.

In addition to fueling rate, the shape of injection pulse is also important to combustion. Compared to standard injections, a low injection rate at the start of an injection followed by a main portion of high rate injection ("boot shape") has higher BMEP (Break Mean Effective Pressure) level, lower NOx and PM (Particulate Matter) emissions. According to equation (2), to change the fueling rate, we have to either change the injector geometry or fuel pressure. For common-rail systems, fuel pressure is kept constant. Therefore, normally fuel shape can only be controlled by adjusting injector geometry. However, injector geometry change could deteriorate fuel atomization and penetration, causing combustion and emission issues. In pre-metered systems, fuel pressure is applied with engine camshaft. On one hand, it is easier to modulate the pressure for controlling injection pulse shape. On the other hand, however, the injection pulse shape is strongly affected by engine camshaft speed.

Figure 7:
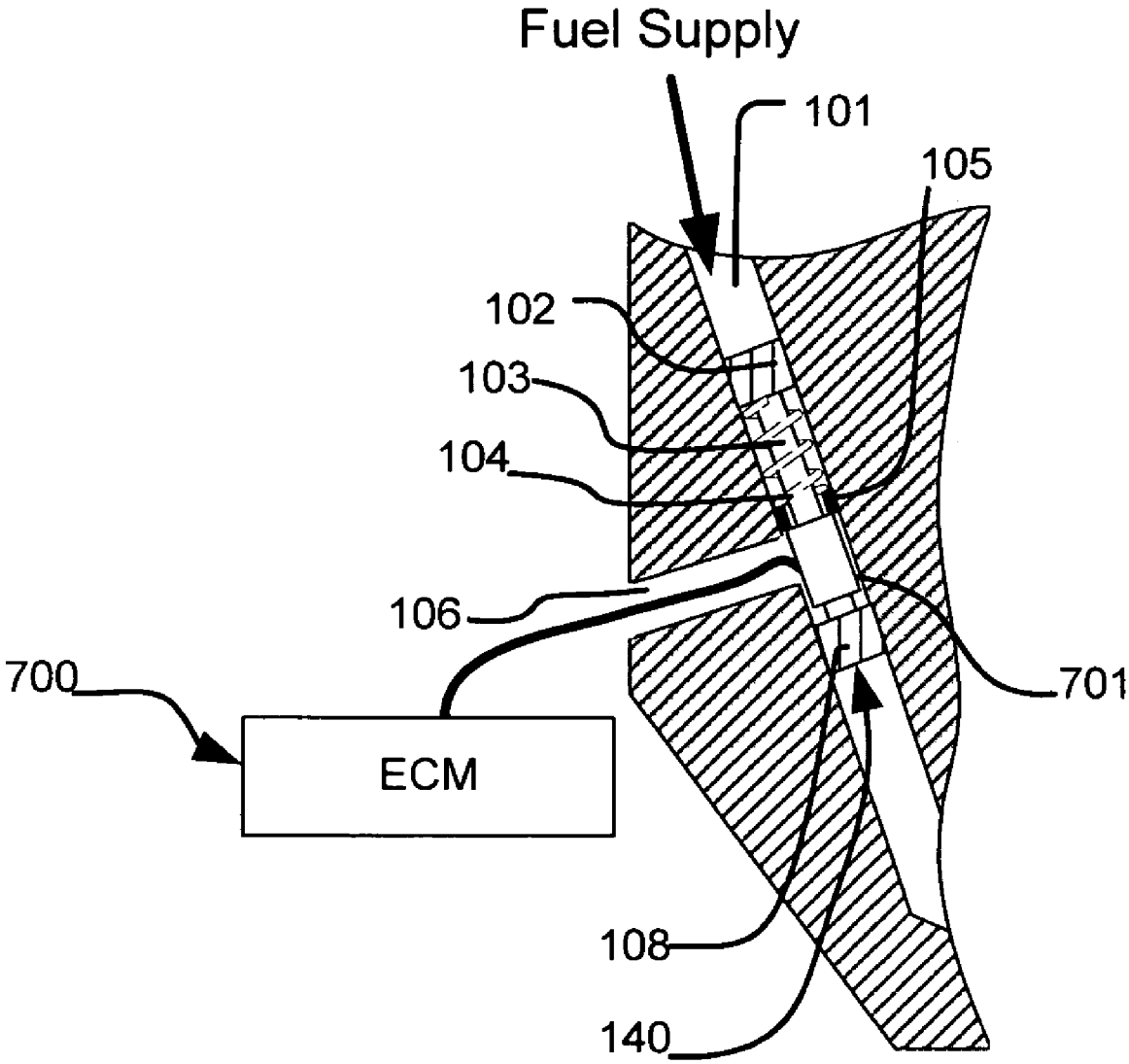
FIG. 7 illustrates a cross-sectional schematic view for the bottom part of an injector with an actuator device according to a second embodiment of the present invention.

In the present invention, the three-state injection and the piston structure allow fuel pressure modulation independent to engine camshaft speed. Referring to FIG. 7, an actuator module 701 that includes an actuator and a piston position sensor is positioned between the spring restraint 105 and the lower piston head 108. The actuator module is controlled by an ECM 700. During injection, the fuel injection pressure is the sum of the fuel supply pressure applied on the upper piston head 102 and the pressure modulated using the actuator module 701, subtracting that imposed by the return spring 104, as described in the following equations:

$$P_i = P_f + \frac{f_a}{A} - P_S \tag{6}$$

where $P_i$ is the fuel injection pressure, $P_f$ the fuel supply pressure, $f_a$ the force applied by the actuator module 701, and $P_s$ is the pressure imposed by the return spring 104;

$$P_s=kl/A \tag{7}$$

where k is the stiffness coefficient of the spring 104.

The fuel supply pressure can be measured using a pressure sensor in fuel rail. With the piston displacement value l (measured using the piston position sensor in the module 701) and required fuel injection pressure value $P_i$ (determined by fuel injection shape), the force command to the actuator in the module 701 is then obtained according to equations (6) and (7). The actuator in the module 701 can be any type of actuators include but not limit to pneumatic actuators, electric actuators, hydraulic actuators, and piezoelectric actuators. Performance of the fuel injection shape control depends on actuator dynamics rather than fuel supply pressure and engine speed.

Fuel injection timing is another important factor to combustion and emission. In the present invention, fuel injection pressure is provided by fuel supply pressure (and an actuator if it is available), which can be controlled constant. Accordingly, flexible fuel injection timing and multi-pulse fuel injection are allowed as that in common-rail systems. These features not only are useful for engine combustion, but also enable in-cylinder dosing for engine after-treatment systems (e.g. for regenerating a diesel particulate filter).

Fuel systems, especially systems in Cl engines, work under higher pressure, which requires the fuel systems must be highly reliable. In common-rail systems, since a constant high fuel pressure is maintained, if a malfunction causes an injector valve is stuck open, fuel could be dumped into combustion chamber continuously, causing catastrophic results. In pre-metered systems, though a stuck open injector won't lead to continuous fuel injection, losing pre-metering control could still cause ill combustion, emission, and safety issues.

Figure 1C:
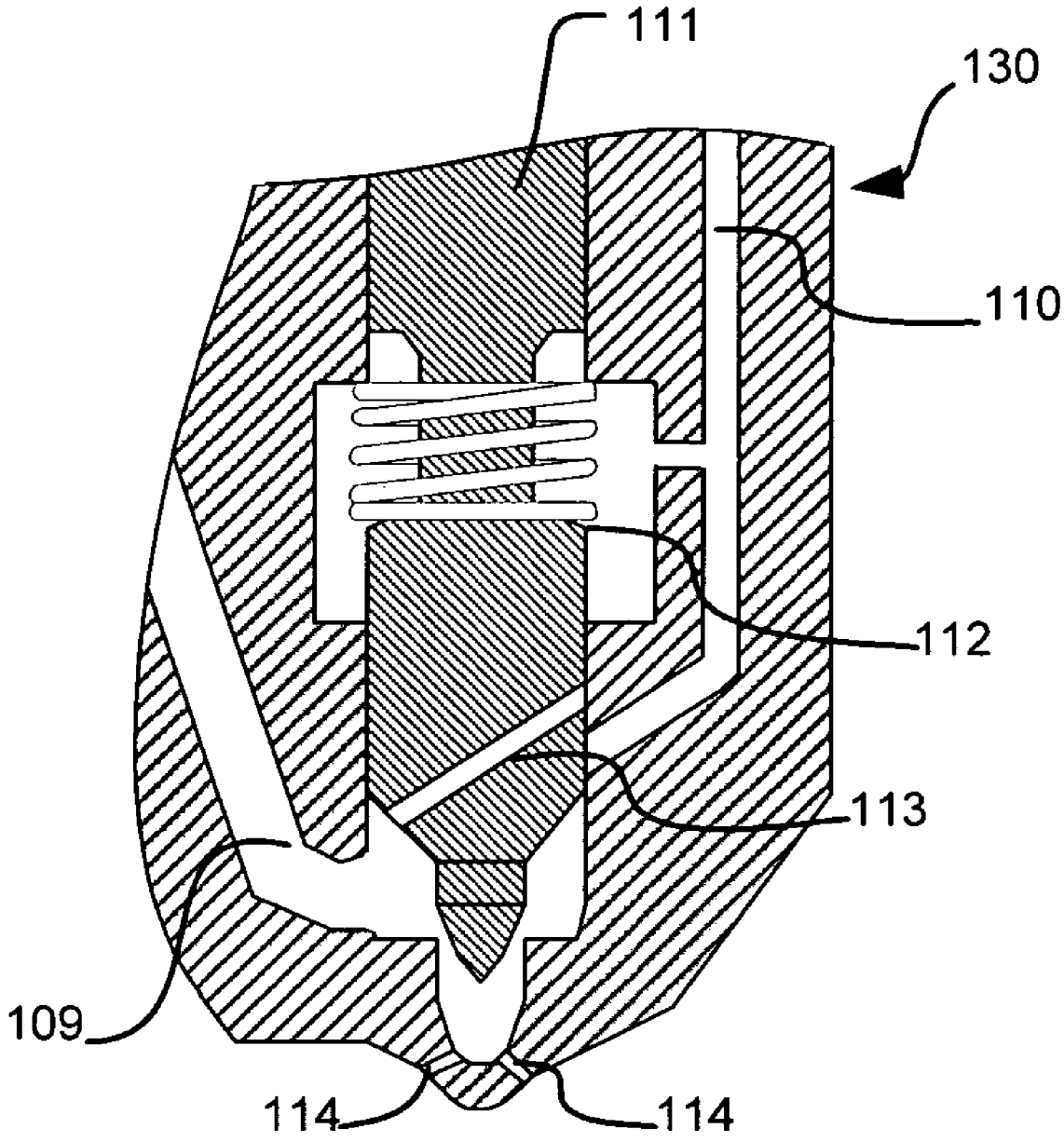

In the present invention, the three-state injection provides the injection a safety nature. Referring to FIGS. 1*a* to 1*c*, in all three injection states, fuel supply has no direct contact to nozzle. Therefore, when the injector is stuck open (FIG. 1*c*), the only fuel that can enter combustion chamber is that enclosed in the cavity 109 and in the channel 101. After this fuel is dumped, no fuel is available, since a refill needs the needle valve go back to its seat. With this safety nature, a stuck open injector can only cause a dead cylinder, deteriorating engine performance without causing other issues.

Figure 6:
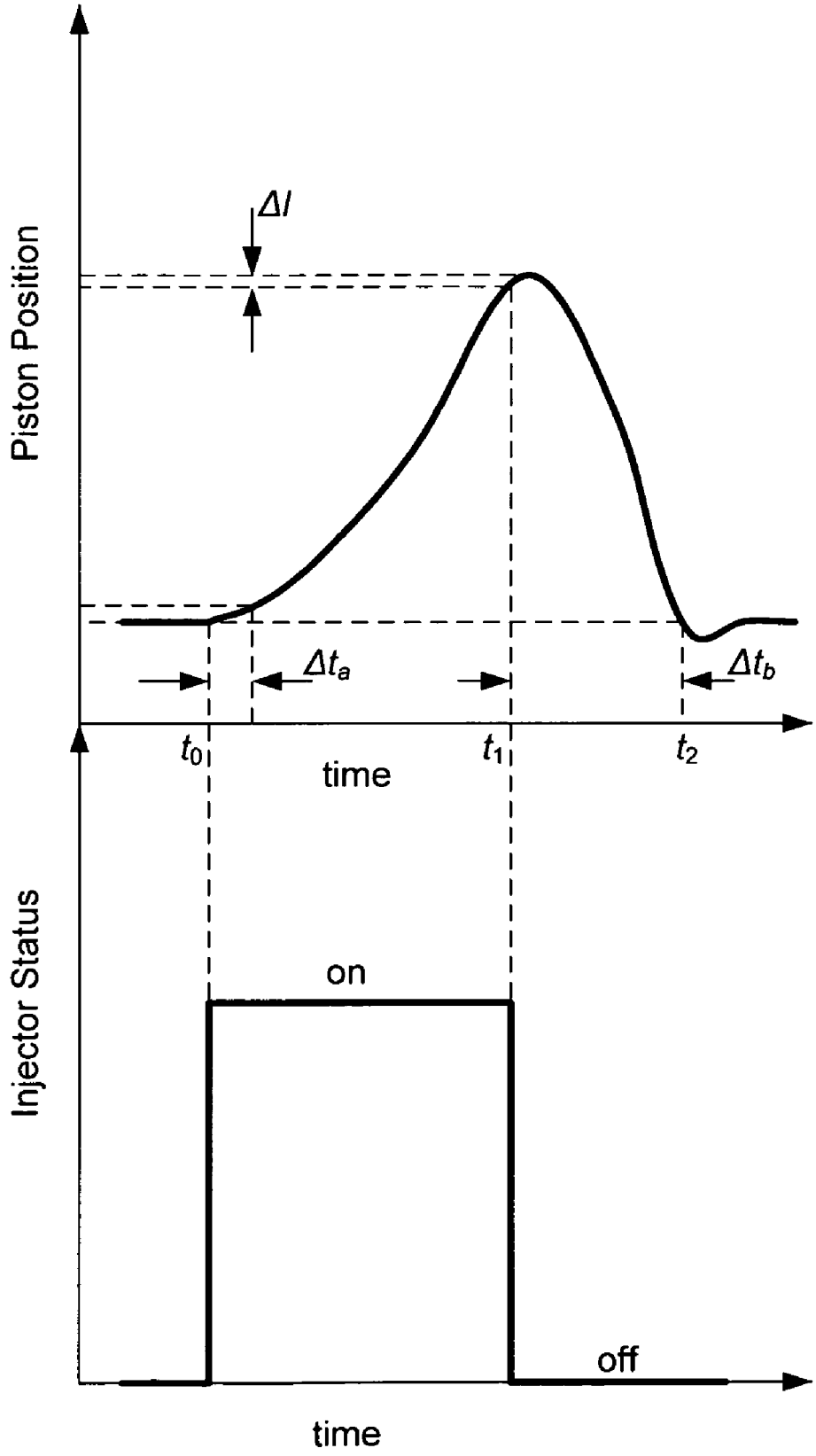
FIG. 6 shows a timing diagram of injection status signals and piston position signals.

The piston device provides more information about injector performance, allowing a few injection problems, such as injector stuck open, injector stuck closed, injector leakage, and injection deterioration be diagnosed effectively. Referring to FIG. 6, when an injector is energized at to, if the injector is not stuck closed, a measurable piston displacement or fuel injection amount should be detected within a period of time $\Delta t_a$. Accordingly, by timing the piston displacement after the injector is energized, a stuck closed issue can be detected. Similarly, leaking injector or stuck open injector can be detected by measuring the piston displacement at a moment ($t_2$) or measuring the time for the piston to return to its original position, after the injector is de-energized.

According to equations (1), (2) and (3), after an injector is energized at $t_0$, the piston displacement l at time t is a function of the pressure difference $\Delta p$ (the difference between fuel pressure and combustion chamber pressure), fuel properties, and the overall cross section area $A_n$ of nozzle orifices:

$$l = \frac{\int_{t_0}^{t} C_D A_n \sqrt{2\rho_f^3 \Delta\rho}\, dt}{A} \tag{8}$$

When injector deterioration causes change in the nozzle orifice area $A_n$ (e.g. injector tip is worn or damaged), there will be a difference between the expected piston displacement calculated using equation (8) and measured piston displacement using the piston position sensor. The larger the difference is, the more the injector deteriorates. The difference value can then be used for diagnostics and adaptive compensation in fueling control.

Figure 8A:
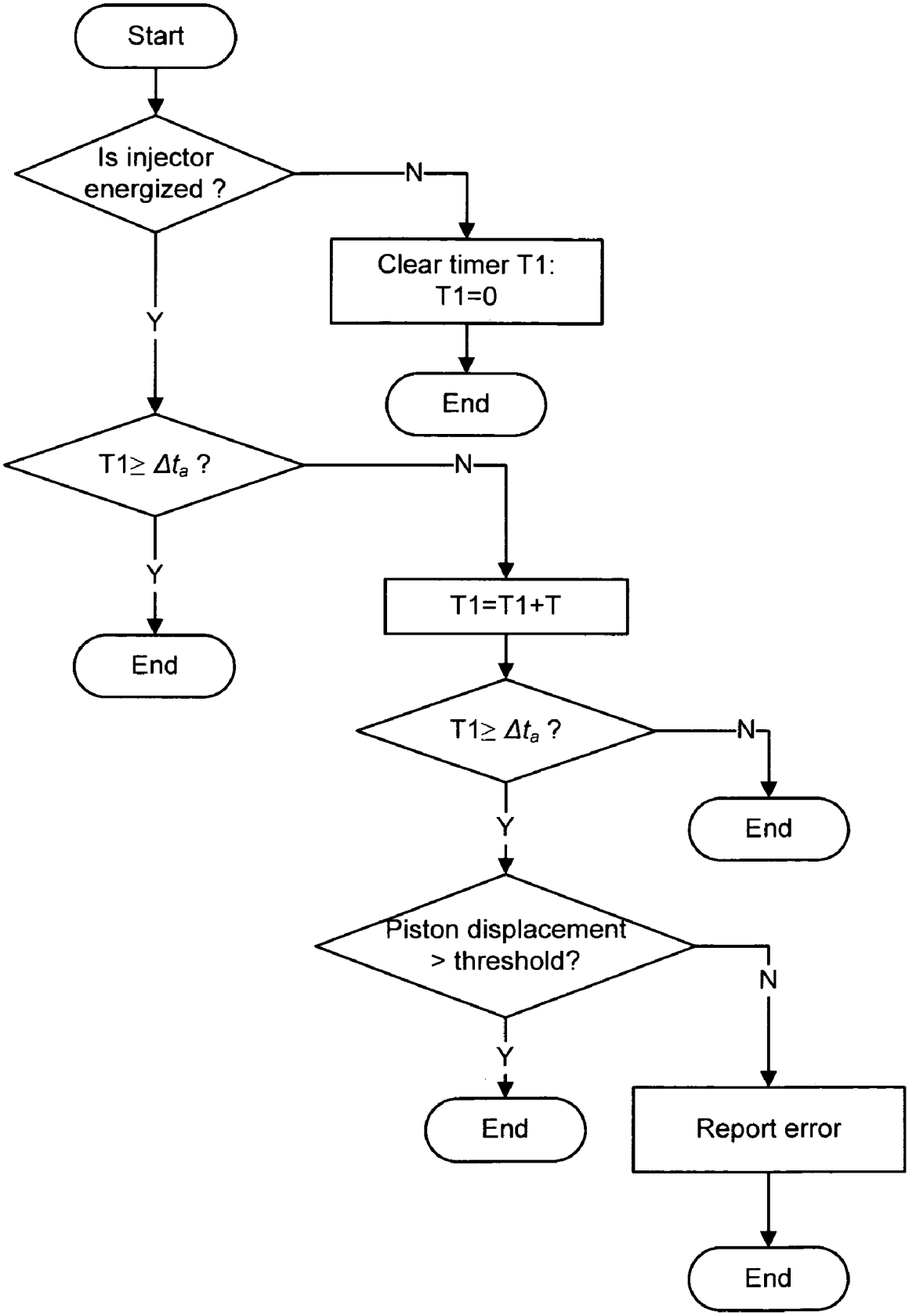
FIG. 8*a*, FIG. 8*b*, FIG. 8*c* are, respectively, flowcharts for exemplary realizations of injector stuck closed diagnosis, injector stuck open/injector leakage diagnosis, and injector deterioration diagnosis

All these diagnostics can be realized using interrupt routines running in an ECM. The flowchart of an exemplary interrupt routine for injector stuck closed diagnosis is shown in FIG. 8*a*. A timer T1 is cleared to zero during initialization. After the routine starts, firstly injector status is examined. If the injector is not energized, then the timer T1 is cleared to zero and the routine ends. When the injector is energized, the value of timer T1 is compared with the time $\Delta t_a$ (FIG. 6). If the value of T1 is equal to or higher than $\Delta t_a$, then a diagnosis for the current injection is complete while the injector is still energized. In this situation, the routine ends. If the value of T1 is lower than $\Delta t_a$, a sampling cycle time T is added to T1, and the value of T1 is compared to $\Delta t_a$ again. The routine ends when T1 value is lower than $\Delta t_a$. Otherwise, the piston displacement, which is the value between the current piston position and the original position before the injector is energized, is examined before the routine ends. If the piston displacement value is lower than a threshold, then the injection rate is lower than expected value. An error is reported.

Figure 8B:
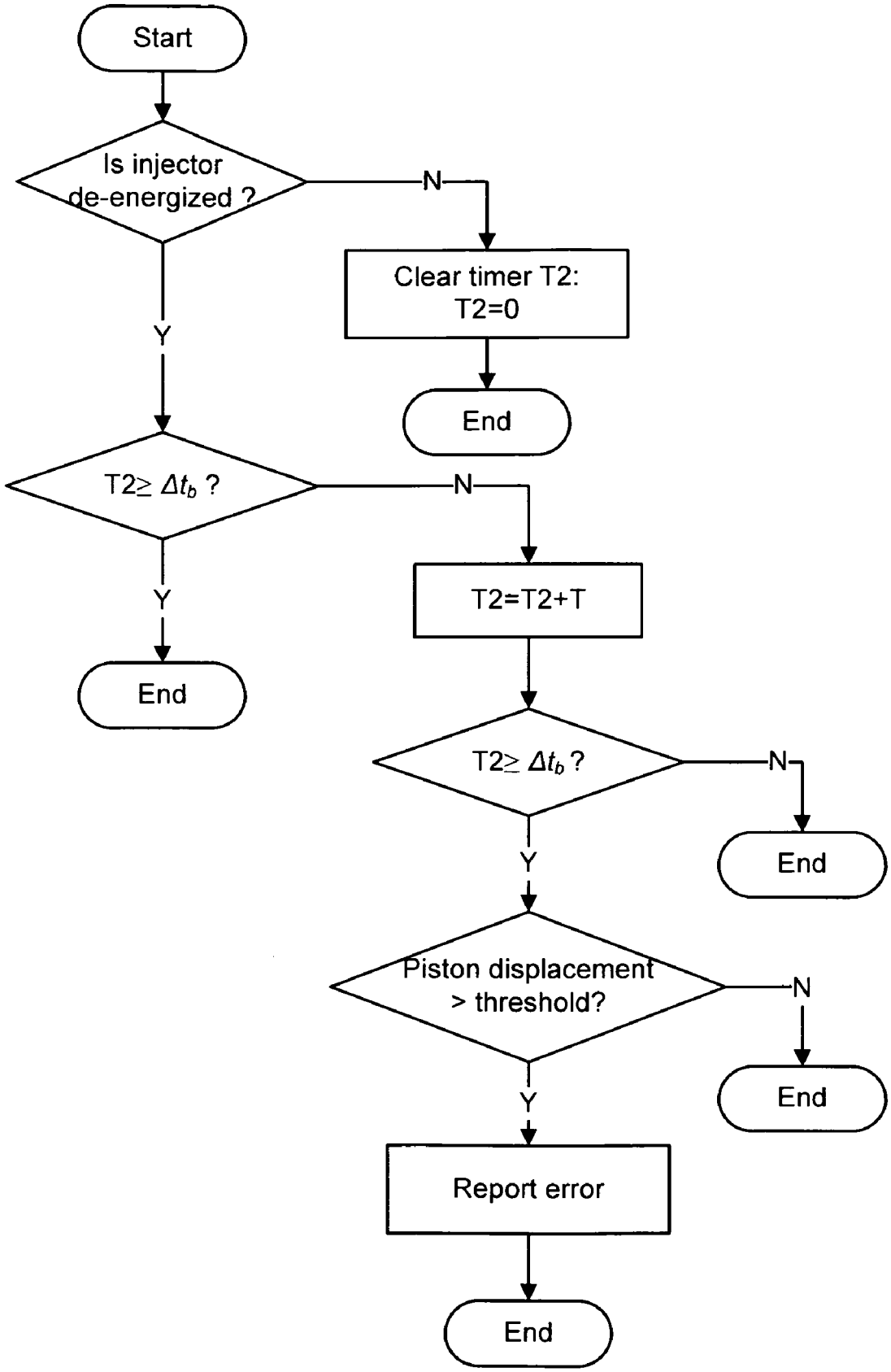

FIG. 8*b* depicts the flowchart of an exemplary interrupt routine for injector leakage and injector stuck open diagnosis. A timer T2 is cleared to zero in initialization. After the routine starts, injector status is examined. The timer T2 is cleared to zero and the routine ends if the injector not de-energized. Otherwise, the value of T2 is compared to the time $\Delta t_b$ (FIG. 6, $\Delta t_b = t_2 - t_1$). If the value of T2 is equal to or higher than $\Delta t_b$, then a diagnosis for the current injection is complete while the injector is still de-energized. In this situation, the routine ends. If the value of T2 is lower than $\Delta t_b$, a sampling time T is added to T2, and the value of T2 is compared to $\Delta t_b$ again. The routine ends when T2 value is lower than $\Delta t_b$. Otherwise, the piston displacement is examined before the routine ends. If the piston displacement value is higher than a threshold, then the injector leaks or is stuck open. An error is reported.

Figure 8C:
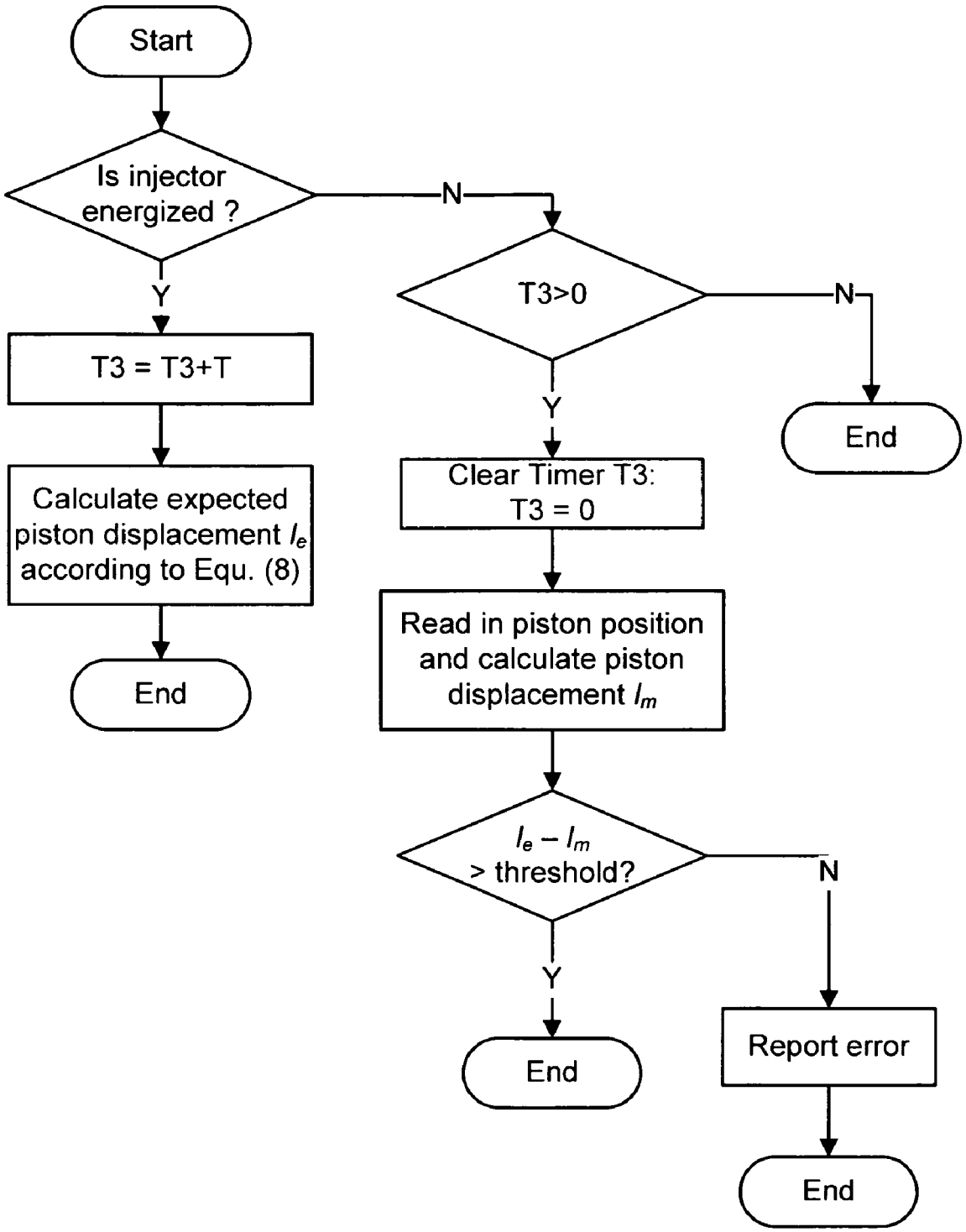

The flowchart of an exemplary interrupt routine for injector deterioration diagnosis is shown in FIG. 8*c*. A timer T3 is cleared to zero in initialization. After the routine starts, injector status is examined. If the injector is energized, then a sampling cycle time T is added to T3, and expected piston displacement $l_e$ is calculated according to equation (8) before the routine ends. When the injector is not energized, if the value of T3 equals to or lower than zero, the routine ends. Otherwise, the timer T3 is cleared to zero, and the value acquired through the piston position sensor is used for calculating piston displacement $l_m$ ($l_m$=current position−original position). The value of $l_m$ is then compared with the expected piston displacement value $l_e$. If the difference ($l_e - l_m$) is within a threshold, then the routine ends. Otherwise, an error of deterioration is reported.

The invention claimed is:

1. A fuel injection apparatus, comprising:

an injector body casting containing a fuel passage communicating to high pressure fuel supply and a pressure cavity for storing fuel supplied from said fuel passage;

at least one orifice for discharging fuel;

at least one piston device including a channel and a piston disposed in said channel, one end of said piston communicating to high pressure fuel supply, and the other one communicating to said pressure cavity;

a nozzle valve element slidably disposed adjacent said injector orifices, controlling fuel flow by moving from an open position at which fuel in said pressure cavity may flow through said injector orifices, and a closed position at which fuel flow is blocked by said nozzle valve element, said nozzle valve element controls fuel flow to said pressure cavity by fluidly connecting said pressure cavity to the fuel passage in said injector body when the fuel injection apparatus is de-energized, and fluidly blocking said pressure cavity from the fuel passage in said injector body when the fuel injection apparatus is fully energized.

2. The fuel injection apparatus of claim 1, wherein said piston device further includes a return spring and spring constraint.

3. The fuel injection apparatus of claim 1, wherein said piston device further includes at least one position sensor detecting the displacement of said piston in said piston device.

4. The fuel injection apparatus of claim 1, wherein said nozzle valve element contains a fuel passage connecting the channel of said piston device to the fuel passage in said injector body when the fuel injection apparatus is de-energized.

5. The fuel injection apparatus of claim 4, wherein the fuel passage in said nozzle valve element disconnects to both of the fuel passage in said injector body and the channel of said piston device during transition between the state in which the fuel injection apparatus is de-energized and the state in which the fuel injection apparatus is fully energized.

6. The fuel injection apparatus of claim 4, wherein the fuel passage in said nozzle valve element fluidly connects to the channel of said piston device when the fuel injection apparatus is fully energized.

7. The fuel injection apparatus of claim 4, wherein the fuel passage in said nozzle valve element fluidly connects to the fuel passage in said injector body when the fuel injection apparatus is fully energized.

8. The fuel injection apparatus of claim 1, wherein said piston device further includes at least one actuator device, which includes at least one actuator that applies a stress on said piston, and at least one position sensor detecting the displacement of said piston in said piston device.

9. A fuel control system, comprising:

an injector body casting containing a fuel passage communicating to high pressure fuel supply and a pressure cavity for storing fuel supplied from said fuel passage, at least one orifice for discharging fuel, a nozzle valve element slidably disposed adjacent said injector orifices, controlling fuel flow by moving from an open position at which fuel in said pressure cavity may flow through said injector orifices, and a closed position at which fuel flow is blocked by said nozzle valve element, and at least one piston device including a channel and a piston disposed in said channel, one end of said piston communicating to high pressure fuel supply, and the other one communicating to said pressure cavity, and at least one position sensor installed in said piston device for detecting the displacement of said piston;

a control module operatively connected to said position sensor, the control module configured to receive an output of said position sensor, the control module configured to process the values acquired from said position sensor, and generate resulting control signals for energizing and de-energizing said fuel injection apparatus.

10. The fuel control system of claim 9, wherein said piston device further includes at least one actuator that applies a stress on said piston.

11. The fuel control system of claim 10, wherein said actuator is operatively connected with said control module, which generates control signals for said actuator.

12. The fuel injection apparatus of claim 9, wherein said nozzle valve element contains a fuel passage connecting the channel of said piston device to the fuel passage in said injector body when the fuel injection apparatus is de-energized.

13. The fuel injection apparatus of claim 9, wherein the fuel passage in said nozzle valve element disconnects to both of the fuel passage in said injector body and the channel of said piston device during transition between the state in which the fuel injection apparatus is de-energized and the state in which the fuel injection apparatus is fully energized.

14. The fuel control system of claim 9, wherein said control module generates injector control signals according to the sum of a feed-forward control value that is calculated based on fueling rate commands, and a feed-back control value that is calculated through a feedback controller, the input to which is the difference between a target piston position value calculated based on the fueling rate commands and a piston displacement value calculated according to the output of said position sensor.

15. The fuel control system of claim 9, wherein said control module firstly generates a fuel injection amount command according to the sum of a feed-forward control value calculated based on fueling rate commands and a feed-back control value that is calculated through a feedback controller, the input to which is the difference between the fueling rate commands and a fueling rate feedback value calculated according to the output of said position sensor, and the fuel injection amount command is then used together with the output of said position sensor in generating injector control signals.

16. A fuel injection diagnostic system, comprising:

an injector body casting containing a fuel passage communicating to high pressure fuel supply and a pressure cavity for storing fuel supplied from said fuel passage, at least one orifice for discharging fuel, a nozzle valve element slidably disposed adjacent said injector orifices, controlling fuel flow by moving from an open position at which fuel in said pressure cavity may flow through said injector orifices, and a closed position at which fuel flow is blocked by said nozzle valve element, and at least one piston device including a channel and a piston disposed in said channel, one end of said piston communicating to high pressure fuel supply, and the other one communicating to said pressure cavity, and at least one position sensor installed in said piston device for detecting the displacement of said piston, and at least one injector state indicator that signifies the energizing status of the fuel injection apparatus;

a diagnostic module operatively connected to said position sensor and said injector state indicator.

17. The fuel injection diagnostic system of claim 16, wherein said diagnostic module reports an error when the displacement value of said piston is lower than a set value at a set moment after said fuel injection apparatus is energized.

18. The fuel injection diagnostic system of claim 16, wherein said diagnostic module reports an error when the displacement value of said piston is higher than a set value at a set moment after said fuel injection apparatus is de-energized.

19. The fuel injection diagnostic system of claim 16, wherein said diagnostic module compares a expected piston displacement calculated based on fuel properties, the difference between fuel supply pressure and the pressure in combustion chamber, the overall cross-section area of said orifices, and the cross-section area of said channel, and reports an error if the difference between the expected piston displacement value and a displacement value measured using said position sensor is higher than a set value.

* * * * *